United States Patent [19]

Gannaway

[11] Patent Number: 5,007,807

[45] Date of Patent: Apr. 16, 1991

[54] HERMETIC COMPRESSOR HAVING RESILIENT INTERNAL MOUNTING

[75] Inventor: Edwin L. Gannaway, Adrian, Mich.

[73] Assignee: Tecumseh Products Company, Tecumseh, Mich.

[21] Appl. No.: 320,564

[22] Filed: Mar. 8, 1989

[51] Int. Cl.[5] ..... F04B 39/00

[52] U.S. Cl. ..... 417/363; 417/902

[58] Field of Search ..... 417/363, 902; 248/635, 248/638

[56] References Cited

U.S. PATENT DOCUMENTS

| | | | |
|---|---|---|---|
| 1,780,724 | 11/1930 | Short . | |
| 1,852,175 | 4/1932 | Mallory . | |
| 2,365,673 | 12/1944 | Benson . | |
| 2,386,248 | 10/1945 | Marzetti . | |
| 2,551,514 | 5/1951 | Truelove et al. . | |
| 2,685,178 | 8/1954 | Eck . | |
| 2,855,139 | 10/1958 | Weibel, Jr. . | |
| 3,138,538 | 6/1964 | Comstock et al. . | |
| 3,182,902 | 5/1965 | Foris | 417/363 |
| 3,272,426 | 9/1966 | Parker | 417/363 |
| 3,788,778 | 1/1974 | Miller | 417/363 |
| 4,108,581 | 8/1978 | Miller et al. . | |
| 4,306,708 | 12/1981 | Gassaway et al. . | |
| 4,312,627 | 1/1982 | Jacobs et al. | 417/902 |
| 4,399,669 | 8/1983 | Jacobs . | |
| 4,470,772 | 9/1984 | Gannaway . | |
| 4,522,378 | 6/1985 | Nelson . | |
| 4,544,334 | 10/1985 | Ellis . | |
| 4,549,859 | 10/1985 | Andrione et al. . | |
| 4,834,336 | 5/1989 | Shimazaki | 248/635 |

*Primary Examiner*—Leonard E. Smith
*Assistant Examiner*—Douglas J. Makosy
*Attorney, Agent, or Firm*—Jeffers, Hoffman & Niewyk

[57] ABSTRACT

A compressor assembly is disclosed including a compressor mechanism resiliently mounted within a hermetically sealed housing. The compressor mechanism includes a crankcase having a radially extending mounting flange portion, which is resiliently connected to the housing sidewall at a plurality of circumferentially spaced locations by a plurality of mounting assemblies. Each mounting assembly comprises a rubber bushing received within a hole in the mounting flange, and a threaded stud that extends through a hole in the bushing and engages a threaded hole in a steel block welded to the housing sidewall above the mounting flange. A washer and retaining nut on the bottom of the threaded stud suspendingly support the mounting flange. In this manner, only a peripheral portion of the washer contacts the mounting flange circumjacent the hole therein, thereby minimizing noise transmission to the housing. Lateral movement of the compressor mechanism is absorbed by the bushing.

20 Claims, 3 Drawing Sheets

HERMETIC COMPRESSOR HAVING RESILIENT INTERNAL MOUNTING

BACKGROUND OF THE INVENTION

The present invention relates generally to a hermetic compressor assembly and, more particularly, to such a compressor assembly having a compressor mechanism mounted within a hermetically sealed housing, wherein it is desired to limit the axial and lateral movement of the compressor mechanism relative to the housing, and to minimize the transmission of noise and vibration from the compressor mechanism to the housing.

In general, compressor assemblies of the type to which the present invention pertains comprise a motor-compressor unit mounted within a hermetically sealed housing. The motor-compressor unit includes an electric motor drivingly coupled to a positive displacement compressor mechanism for compressing refrigerant. During compressor operation, the steady-state inertial forces produced by the rotating masses of the unit are substantially balanced by the provision of counterweights in both the motor and the compressor mechanism, and by the location of mounting means at the axial center of mass. Furthermore, the axially supported mass of the motor-compressor unit helps dampen any axial vibratory forces. However, gas load forces produced by gas compression, and torque forces imparted to the compressor by the dynamic operation of the motor during starting and stopping, result in vibratory forces in a lateral plane.

Several prior art methods for immovably mounting a motor-compressor unit within a housing involve direct attachment therebetween, such as by circumferentially welding, clamping, or shrink fitting a mounting flange of the compressor mechanism to the housing sidewall. Alternatively, a mounting plate to which the compressor mechanism is attached may serve as the mounting flange. In one such arrangement, the housing comprises two interfitting portions between which the mounting flange or mounting plate is clamped or axially supported. Where the flange is only axially supported, the aforementioned lateral forces may cause rotation of the motor compressor unit within the housing.

A problem associated with prior art mounting mechanisms providing direct mechanical attachment between the compressor mechanism and the housing, is that vibrations are mechanically transmitted to the housing through the mounting mechanism, thereby producing noise and vibration in the housing. Also, other noises produced by the compressor mechanism can be transmitted directly to the housing through the mounting mechanism.

In order to reduce the transmission of vibration and noise from the compressor mechanism to the housing, there have been developed resilient suspension mounting systems incorporating springs and the like, which necessarily permit substantial movement of the compressor within the housing. As previously alluded to, it is desirable that the transmission of vibration and noise to the housing be minimized; however, it is also important, particularly in direct suction hermetic compressors wherein a suction tube extends between the housing sidewall and the compressor crankcase, that the compressor mechanism be limited in its movement relative to the housing so as to avoid damage to the compressor. Specifically, where the suction tube extends through a pressurized housing interior and includes O-ring seals at its connecting ends, damage to the O-ring seals could result from excessive movement of the compressor mechanism relative to the housing.

While the prior art mounting mechanisms have addressed separately the problems of restricting compressor movement relative to the housing and minimizing vibration and noise transmission from the compressor to the housing, a satisfactory combined solution has not been proposed, particularly for a direct suction hermetic compressor assembly exhibiting the aforementioned lateral vibratory forces. Instead, the prior art suspension mounting mechanisms have, for the most part, emphasized axially oriented spring support. Such systems inherently lack lateral support, which results in excessive lateral movement of the compressor mechanism and associated damages caused thereby.

SUMMARY OF THE INVENTION

The present invention overcomes the disadvantages of the above-described prior art internal mounting methods by providing an improved resilient mounting method for mounting a motor-compressor unit within a hermetic housing, wherein vibrations of the compressor mechanism occurring in the lateral plane are absorbed with minimal transmission of noise and vibration to the housing and with restricted lateral movement of the compressor mechanism relative to the housing.

Generally, the invention provides a mounting mechanism wherein lateral movement of a compressor mechanism within a hermetic housing is absorbed and restrained by a resilient member, and axial support of the compressor mechanism is achieved by minimal contact area between the compressor crankcase and mounting hardware attached to the housing.

More specifically, the invention provides, in one form thereof, a vertically disposed hermetic compressor assembly wherein a compressor mechanism is resiliently mounted within the housing by means of a plurality of circumferentially spaced mounting mechanisms The compressor mechanism includes a radially extending mounting flange having a plurality of vertically oriented mounting bores extending therethrough. A mounting mechanism associated with each mounting bore comprises an anchor member fixedly attached to the housing sidewall, wherein the anchor member extends through the mounting bore. A resilient member occupies the space within the mounting bore intermediate the anchor member and the mounting flange. Each mounting mechanism includes an axial support connected to the anchor member and contacting the bottom surface of the flange member circumjacent the mounting bore.

An advantage of the resilient mounting system of the present invention is that lateral forces produced by the compressor mechanism are absorbed by a resilient member, thereby reducing noise and vibration transmitted to the housing.

Another advantage of the resilient mounting system of the present invention is that axial support of the compressor mechanism is achieved through minimal surface area contact, thereby minimizing the transmission of noise through contacting mounting components.

A further advantage of the resilient mounting system of the present invention is that lateral and axial movement of the compressor mechanism relative to the housing is limited while at the same time transmission of vibration and noise to the housing is minimized.

Yet another advantage of the resilient mounting system of the present invention is that, in a direct suction compressor assembly, the mounting system enhances the use of O-ring seals for the suction inlet conduit, by limiting compressor movement that would otherwise destroy the seals.

A still further advantage of the resilient mounting system of the present invention is that assembly of the hermetic compressor is simplified.

The resilient mounting apparatus of the present invention, in one form thereof, relates to a vertically disposed compressor assembly comprising a compressor mechanism within a hermetically sealed housing having a sidewall, wherein the compressor mechanism includes a radially extending mounting flange having a top surface and a bottom surface. A mounting apparatus is provided for resiliently mounting the compressor mechanism to the housing sidewall, and includes a plurality of circumferentially spaced mounting bores formed in the mounting flange. Each mounting bore extends vertically through the mounting flange between the top surface and the bottom surface thereof. A plurality of anchoring members, corresponding to the plurality of mounting bores, are connected to the housing sidewall and extend substantially coaxially through respective mounting bores. In this manner, an annular space is defined intermediate each anchoring member and its respective mounting bore. There is also provided a plurality of resilient members corresponding to the plurality of mounting bores. Each resilient member is disposed within a respective mounting bore in a manner to substantially occupy the annular space. An axial support associated with each of anchoring members provides axial support for the compressor mechanism. Each axial support is connected to its respective anchoring member and contacts the mounting flange bottom surface at a location thereon circumjacent a respective mounting bore. Accordingly, the compressor mechanism is axially supported, and movement of the compressor mechanism in a lateral plane is resiliently restrained.

The present invention further provides, in one form thereof, a compressor assembly comprising a vertically disposed hermetically sealed housing including a sidewall. A compressor mechanism for compressing refrigerant is disposed within the housing and includes a crankcase having a radially extending mounting flange. The mounting flange includes a top surface, a bottom surface, and a plurality of circumferentially spaced vertical bores extending therebetween. In accord with this form of the invention, a mounting mechanism is provided for mounting the compressor mechanism to the housing sidewall. The mounting mechanism includes a plurality of circumferentially spaced mounting blocks, each corresponding to one of the vertical bores, wherein each mounting block is attached to the housing sidewall. There is also provided a plurality of vertically disposed elongate stud members corresponding to the plurality of mounting blocks. Each stud member is connected at a top end thereof to a respective mounting block, and extends downwardly within the housing in spaced relation to the housing sidewall. The bottom end of each stud member is unattached. A resilient bushing is received within each vertical bore, and includes a central aperture through which a respective stud member extends. Accordingly, the bushing is intermediate the stud member and the vertical bore for resiliently limiting lateral movement therebetween. Also, the compressor mechanism is axially supported by a support member connected to each stud member bottom end. The support member contacts an annular area of the mounting flange bottom surface circumjacent a respective mounting bore. In one aspect of the invention according to this form, the resilient mounting mechanism includes a stop at the top end of the stud member to limit axially upward movement of the compressor mechanism.

DESCRIPTION OF THE PREFERRED EMBODIMENT

Figure 1:
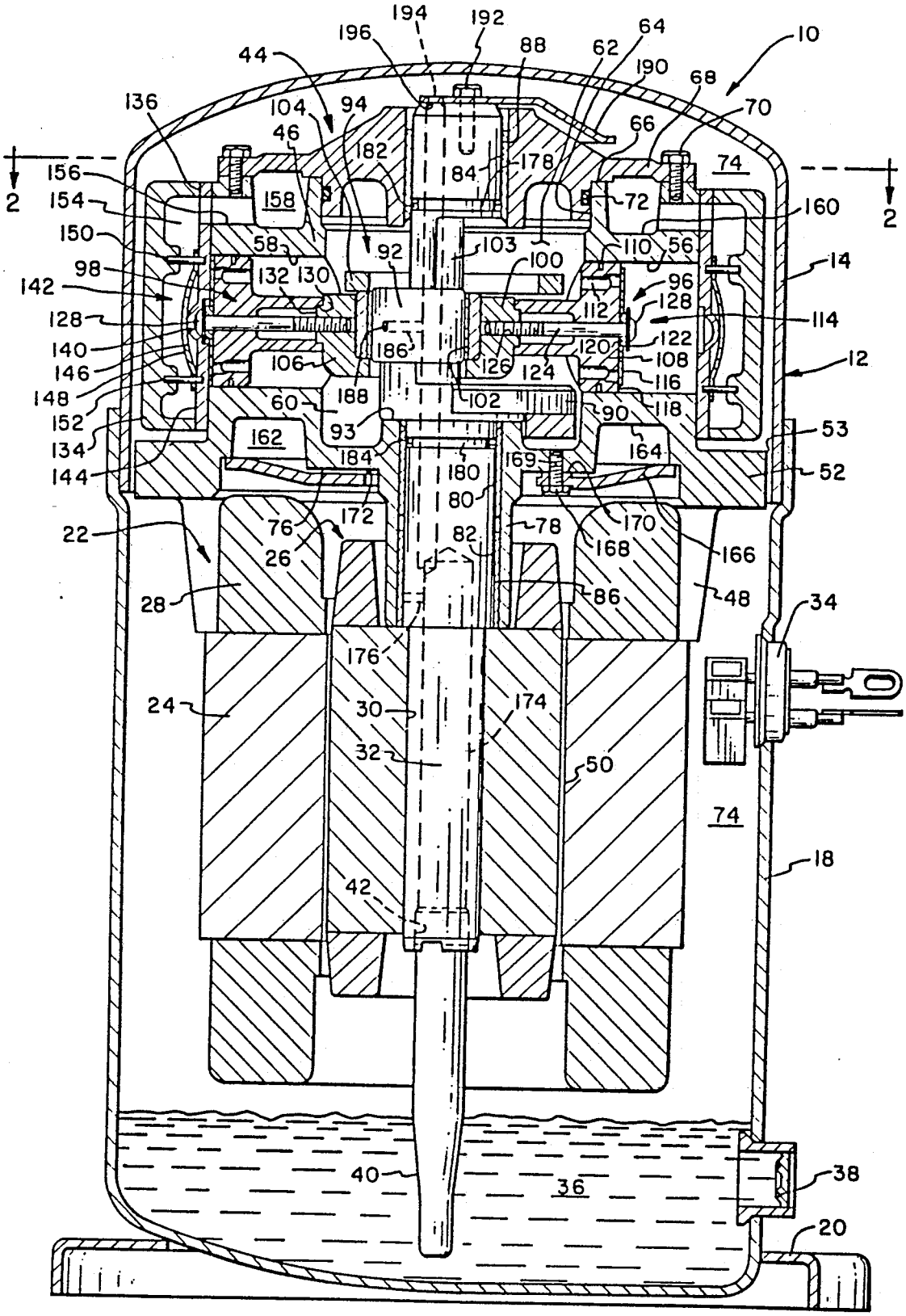
FIG. 1 is a side sectional view of a compressor of the type to which the present invention pertains, taken along the line 1—1 in FIG. 2 and viewed in the direction of the arrows.

In an exemplary embodiment of the invention as shown in the drawings, and in particular by referring to FIG. 1, a compressor assembly 10 is shown having a housing generally designated at 12. The housing has a top portion 14 and a bottom portion 18. The two housing portions are hermetically secured together as by welding or brazing. A mounting flange 20 is welded to the bottom portion 18 for mounting the compressor in a vertically upright position. Located within hermetically sealed housing 12 is an electric motor generally designated at 22 having a stator 24 and a rotor 26. The stator is provided with windings 28. Rotor 26 has a central aperture 30 provided therein into which is secured a crankshaft 32 by an interference fit. A terminal cluster 34 is provided in bottom portion 18 of housing 12 for connecting the compressor to a source of electric power. Where electric motor 22 is a three-phase motor, bidirectional operation of compressor assembly 10 is achieved by changing the connection of power at terminal cluster 34.

Compressor assembly 10 also includes an oil sump 36 located in bottom portion 18. An oil sight glass 38 is provided in the sidewall of bottom portion 18 to permit viewing of the oil level in sump 36. A centrifugal oil pick-up tube 40 is press fit into a counterbore 42 in the end of crankshaft 32. Oil pick-up tube 40 is of conventional construction and includes a vertical paddle (not shown) enclosed therein.

Figure 2:
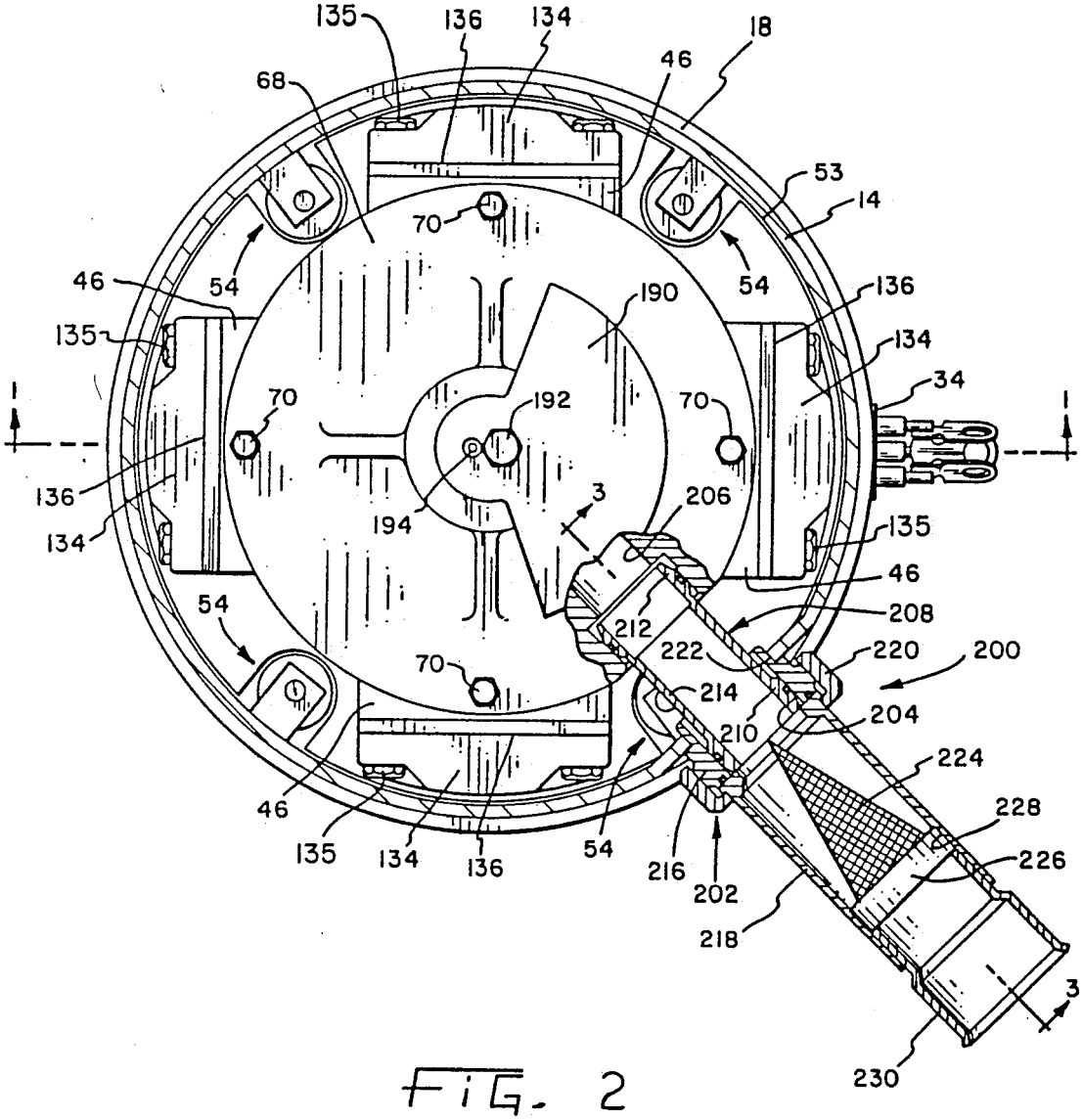
FIG. 2 is a top view of the compressor mechanism within the housing of the compressor of FIG. 1, showing a sectional view of the housing taken along line 2—2 in FIG. 1 and viewed in the direction of the arrows, a portion of the compressor mechanism being cut away to show the engagement of the suction tube insert within the suction inlet opening of the crankcase.
Figure 3:
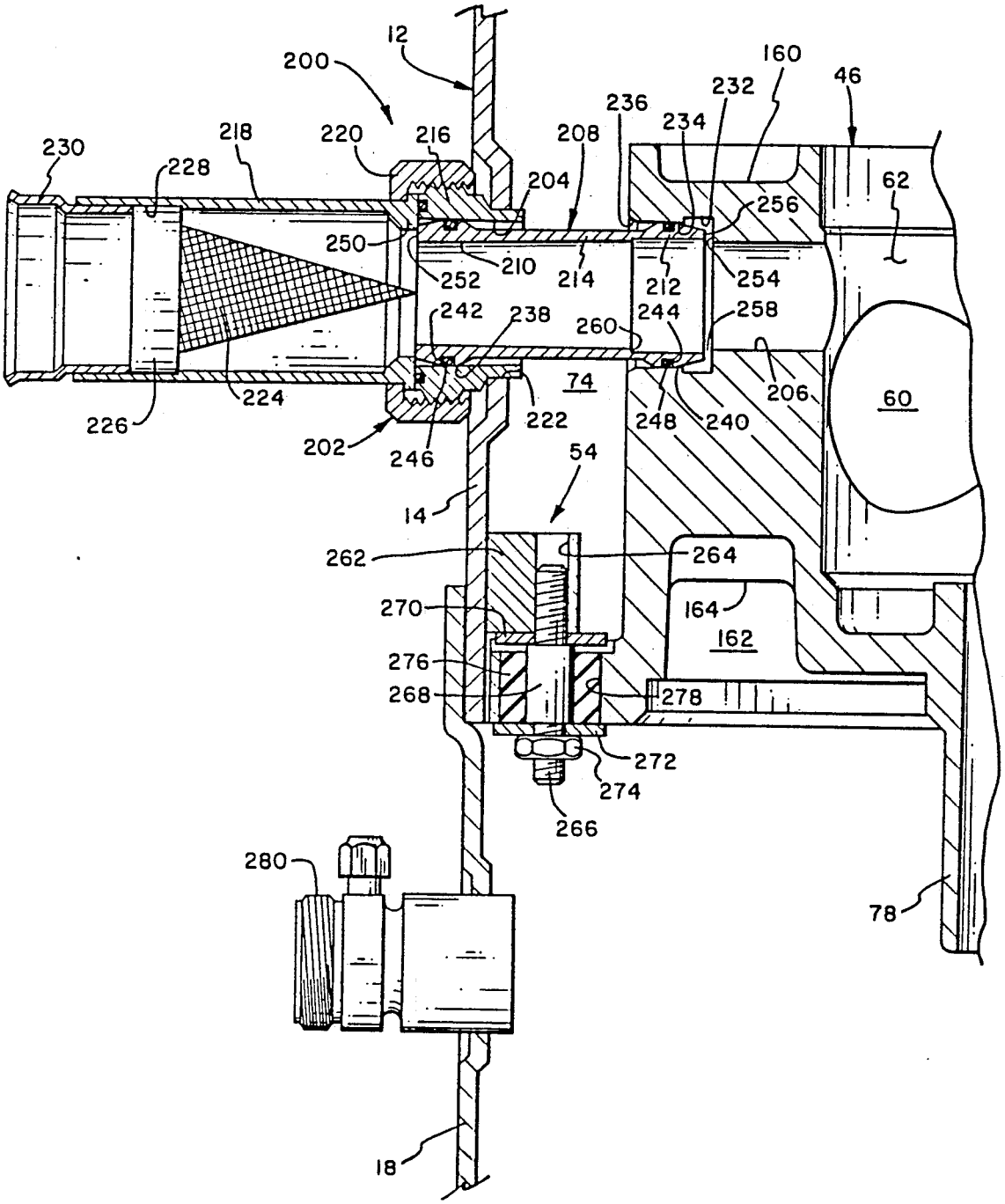
FIG. 3 is a fragmentary sectional view of the crankcase and housing assembly of FIG. 2 taken along the line 3—3 in FIG. 2 and viewed in the direction of the arrows, particularly showing a resilient mounting assembly in accordance with the present invention.

Also enclosed within housing 12, in the embodiment of FIG. 1, is a compressor mechanism generally designated at 44. Compressor mechanism 44 comprises a crankcase 46 including a plurality of mounting lugs 48 to which motor stator 24 is attached such that there is an annular air gap 50 between stator 24 and rotor 26. Crankcase 46 also includes a circumferential mounting flange 52 supported within housing 12 by means of a plurality of resilient mounting assemblies 54 in accord with the present invention, as shown in FIGS. 2 and 3.

An annular space 53, intermediate the peripheral edge of flange 52 and housing top portion 14, provides communication between the top and bottom ends of housing 12 for return of lubricating oil and equalization of discharge pressure within the entire housing interior.

Compressor mechanism 44, as illustrated in the preferred embodiment, takes the form of a reciprocating piston, scotch yoke compressor. More specifically, crankcase 46 includes four radially disposed cylinders, two of which are shown in FIG. 1 and designated as cylinder 56 and cylinder 58. The four radially disposed cylinders open into and communicate with a central suction cavity 60 defined by inside cylindrical wall 62 in crankcase 46. A relatively large pilot hole 64 is provided in a top surface 66 of crankcase 46. Various compressor components, including the crankshaft, are assembled through pilot hole 64. A top cover such as cage bearing 68 is mounted to the top surface of crankcase 46 by means of a plurality of bolts 70 extending through bearing 68 into top surface 66. When bearing 68 is assembled to crankcase 46, an O-ring seal 72 isolates suction cavity 60 from a discharge pressure space 74 defined by the interior of housing 12.

Crankcase 46 further includes a bottom surface 76 and a bearing portion 78 extending therefrom. Retained within bearing portion 78, as by press fitting, is a sleeve bearing assembly comprising a pair of sleeve bearings 80 and 82. Two sleeve bearings are preferred rather than a single longer sleeve bearing to facilitate easy assembly into bearing portion 78. Likewise, a sleeve bearing 84 is provided in cage bearing 68, whereby sleeve bearings 80, 82, and 84 are in axial alignment. Sleeve bearings 80, 82, and 84 are manufactured from steel-backed bronze.

Referring once again to crankshaft 32, there is provided thereon journal portions 86 and 88, wherein journal portion 86 is received within sleeve bearings 80 and 82, and journal portion 88 is received within sleeve bearing 84. Accordingly, crankshaft 32 is rotatably journalled in crankcase 46 and extends through a suction cavity 60. Crankshaft 32 includes a counterweight portion 90 and an eccentric portion 92 located opposite on another with respect to the central axis of rotation of crankshaft 32 to thereby counterbalance one another. The weight of crankshaft 32 and rotor 26 is supported on thrust surface 93 of crankcase 46.

Eccentric portion 92 is operably coupled by means of a scotch yoke mechanism 94 to a plurality of reciprocating piston assemblies corresponding to, and operably disposed within, the four radially disposed cylinders in crankcase 46. As illustrated in FIG. 1, piston assemblies 96 and 98, representative of four radially disposed piston assemblies operable in compressor assembly 10, are associated with cylinders 56 and 58, respectively.

Scotch yoke mechanism 94 comprises a slide block 100 including a cylindrical bore 102 in which eccentric portion 92 is journalled. In the preferred embodiment, cylindrical bore 102 is defined by a steel backed bronze sleeve bearing press fit within slide block 100. A reduced diameter portion 103 in crankshaft 32 permits easy assembly of slide block 100 onto eccentric portion 92. Scotch yoke mechanism 94 also includes a pair of yoke members 104 and 106 which cooperate with slide block 100 to convert orbiting motion of eccentric portion 92 to reciprocating movement of the four radially disposed piston assemblies. For instance, FIG. 1 shows yoke member 106 coupled to piston assemblies 96 and 98, whereby when piston assembly 96 is at a bottom dead center (BDC) position, piston assembly 98 will be at a top dead center (TDC) position.

Referring once again to piston assemblies 96 and 98, each piston assembly comprises a piston member 108 having an annular piston ring 110 to allow piston member 108 to reciprocate within a cylinder to compress gaseous refrigerant therein. Suction ports 112 extending through piston member 108 allow suction gas within suction cavity 60 to enter cylinder 56 on the compression side of piston 108.

A suction valve assembly 114 is also associated with each piston assembly, and will now be described with respect to piston assembly 96 shown in FIG. 1. Suction valve assembly 114 comprises a flat, disk-shaped suction valve 116 which in its closed position covers suction ports 112 on a top surface 118 of piston member 108. Suction valve 116 opens and closes by virtue of its own inertia as piston assembly 96 reciprocates in cylinder 56. More specifically, suction valve 116 rides along a cylindrical guide member 120 and is limited in its travel to an open position by an annular valve retainer 122.

As illustrated in FIG. 1, valve retainer 122, suction valve 116, and guide member 120 are secured to top surface 118 of piston member 108 by a threaded bolt 124 having a buttonhead 128. Threaded bolt 124 is received within a threaded hole 126 in yoke member 106 to secure piston assembly 96 thereto. As shown with respect to the attachment of piston assembly 98 to yoke member 106, an annular recess 130 is provided in each piston member and a complementary boss 132 is provided on the corresponding yoke member, whereby boss 132 is received within recess 130 to promote positive, aligned engagement therebetween.

Compressed gas refrigerant within each cylinder is discharged through discharge ports in a valve plate. With reference to cylinder 58 in FIG. 1, a cylinder head cover 134 is mounted to crankcase 46 with a valve plate 136 interposed therebetween. A valve plate gasket is provided between valve plate 136 and crankcase 46. Valve plate 136 includes a coined recess 140 into which buttonhead 128 of threaded bolt 124 is received when piston assembly 98 is positioned at top dead center (TDC).

A discharge valve assembly 142 is situated on a top surface 144 of valve plate 136. Generally, compressed gas is discharged through valve plate 136 past an open discharge valve 146 that is limited in its travel by a discharge valve retainer 148. Guide pins 150 and 152 extend between valve plate 136 and cylinder head cover 134, and guidingly engage holes in discharge valve 146 and discharge valve retainer 148 at diametrically opposed locations therein. Valve retainer 148 is biased against cylinder head cover 134 to normally retain discharge valve 146 against top surface 144 at the diametrically opposed locations. However, excessively high mass flow rates of discharge gas or hydraulic pressures caused by slugging may cause valve 146 and retainer 148 to be guidedly lifted away from top surface 144 along guide pins 150 and 152.

Referring once again to cylinder head cover 134, a discharge space 154 is defined by the space between top surface 144 of valve plate 136 and the underside of cylinder head cover 134. Cover 134 is mounted about its perimeter to crankcase 46 by a plurality of bolts 135, shown in FIG. 2. Discharge gas within discharge space 154 associated with each respective cylinder passes through a respective connecting passage 156, thereby providing communication between discharge space 154 and a top annular muffling chamber 158. Chamber 158 is defined by an annular channel 160 formed in top surface 66 of crankcase 46, and cage bearing 68. As illustrated, connecting passage 156 passes not only through crankcase 46, but also through holes in valve plate 136 and the valve plate gasket.

Top muffling chamber 158 communicates with a bottom muffling chamber 162 by means of passageways extending through crankcase 46. Chamber 162 is defined by an annular channel 164 and a muffler cover plate 166. Cover plate 166 is mounted against bottom surface 76 at a plurality of circumferentially spaced locations by bolts 168 and threaded holes 169. Bolts 168 may also take the form of large rivets or the like. A plurality of spacers 170, each associated with a respective bolt 168, space cover plate 166 from bottom surface 76 at the radially inward extreme of cover plate 166 to form an annular exhaust port 172. The radially outward extreme portion of cover plate 166 is biased in engagement with bottom surface 76 to prevent escape of discharge gas from within bottom muffling chamber 162 at this radially outward location.

Compressor assembly 10 of FIG. 1 also includes a lubrication system associated with oil pick-up tube 40 previously described. Oil pick-up tube 40 acts as an oil pump to pump lubricating oil from sump 36 upwardly through an axial oil passageway 174 extending through crankshaft 32. An optional radial oil passageway 176 communicating with passageway 174 may be provided to initially supply oil to sleeve bearing 82. The disclosed lubrication system also includes annular grooves 178 and 180 formed in crankshaft 32 at locations along the crankshaft adjacent opposite ends of suction cavity 60 within sleeve bearings 80 and 84. Oil is delivered into annular grooves 178, 180 behind annular seals 182, 184, respectively retained therein. Seals 182, 184 prevent high pressure gas within discharge pressure space 74 in the housing from entering suction cavity 60 past sleeve bearings 84 and 80, 82, respectively. Also, oil delivered to annular grooves 178, 180 behind seals 182 and 184 lubricate the seals as well as the sleeve bearings.

Another feature of the disclosed lubrication system of compressor assembly 10 in FIG. 1, is the provision of a pair of radially extending oil ducts 186 from axial oil passageway 174 to a corresponding pair of openings 188 on the outer cylindrical surface of eccentric portion 92.

A counterweight 190 is attached to the top of shaft 32 by means of an off-center mounting bolt 192. An extruded hole 194 through counterweight 190 aligns with axial oil passageway 174, which opens on the top of crankshaft 32 to provide an outlet for oil pumped from sump 36. An extruded portion 196 of counterweight 190 extends slightly into passageway 174 which, together with bolt 192, properly aligns counterweight 190 with respect to eccentric portion 92.

Referring now to FIGS. 2 and 3, a suction line connector assembly 200 is shown, whereby refrigerant at suction pressure is supplied from a refrigeration system (not shown) external of housing 12, through discharge pressure space 74 within the housing, into suction cavity 60 within crankcase 46. Generally, connector assembly 200 comprises a housing fitting assembly 202 having a fitting bore 204 extending therethrough, a suction inlet bore 206 formed in crankcase 46 that communicates with suction cavity 60, and a suction conduit 208. Suction conduit 208 has a first axial end 210 received within fitting bore 204, a second axial end 212 received within suction inlet bore 206, and an intermediate portion 214 extending through discharge pressure space 74.

Housing fitting assembly 202 comprises a housing fitting member 216, a removable outer fitting member 218, and a threaded nut 220 that is rotatable yet axially retained on outer fitting member 218. Housing fitting member 216 is received within an aperture 222 in top portion 14 of the housing, and is sealingly attached thereto as by welding, brazing, soldering, or the like. Outer member 218 incorporates a conical screen filter 224 having a mounting ring 226 at the base end thereof that is slip fit into a counterbore 228 provided in the outer end of outer member 218. In such an arrangement, filter 224 may be easily removed for cleaning or replacement. Filter 224 is retained within counterbore 228 by means of a copper fitting 230 that is soldered or brazed to the suction tubing of a refrigeration system (not shown). In turn, copper fitting 230 is received within counterbore 228 and is soldered or brazed to outer member 218. Housing fitting assembly 202 is a slightly modified version of a fitting that is commercially available from Primor of Adrian, Mich.

Suction line connector assembly 200 will now be more particularly described with reference to FIG. 3. Suction inlet bore 206 extends radially outwardly from suction cavity 60 along an axis substantially perpendicular to the housing sidewall. Likewise, fitting bore 204 extends through the housing sidewall along an axis perpendicular thereto. Upon assembly of compressor 10 of the preferred embodiment, it is intended that the axes of suction inlet bore 206 and fitting bore 204 be substantially aligned. However, due to machining and assembly tolerances, and dynamic forces acting on the compressor mechanism during operation, the bores may not be initially aligned nor remain so during compressor operation. Therefore, as described hereinafter, means are provided for sealingly engaging first end portion 210 within fitting bore 204 and second end portion 212 within suction inlet bore 206, in a manner to permit axial and angular movement of first end portion 210 and second end portion 212 relative to fitting bore 204 and suction inlet bore 206, respectively, in response to limited movement of compressor mechanism 44 relative to housing 12.

Suction inlet bore 206 includes an annular relief 232 for the purpose of permitting a honing or burnishing tool to bearingize a cylindrical sealing surface 234, which constitutes the radially outermost portion of suction inlet bore 206. Likewise, fitting bore is polished, or bearingized, to provide a smooth cylindrical sealing surface. A chamfer 236 is provided at the opening of suction inlet bore 206 to facilitate insertion of first end portion 210 of suction conduit 208.

Suction conduit 208 comprises a short length of spun or swedged cylindrical tubing, wherein first end portion 210 is formed with an annular protuberance 238 and second end portion 212 is formed with a corresponding annular protuberance 240. Annular protuberances 238 and 240 are essentially at locations on suction conduit 208 where the diameter is greater than axially adjacent portions. More specifically, protuberances 238 and 240 of the disclosed embodiment slope away from a central point of maximum diameter toward decreasing conduit diameter, thereby permitting each end of the suction conduit to pivot within its associated bore. The amount of pivoting is limited by the geometry of the protuberance and the axial penetration of the conduit within the bore.

Although it is conceivable that a rounded, well-polished protuberance could provide sealing engagement of a conduit end portion within a bore, protuberances 238 and 240 are formed with annular seal grooves 242 and 244, into which O-ring seals 246 and 248 are received, respectively. The cross-sectional diameter of each O-ring seal is greater than the depth of its respective groove and, therefore, the seal extends above the surface of the protuberance at its maximum diameter and sealingly contacts the cylindrical sealing surface of its associated bore. In the preferred embodiment, O-ring seals 246 and 248 are composed of a rubber material, such as neoprene or viton, and have a cross-sectional diameter of approximately 0.070 inches. The annular clearance between each protuberance and its associated bore is approximately 0.005 inches, while the depth of each seal groove is approximately 0.050–0.055 inches. Therefore, the O-ring seals are under approximately 0.10–0.15 inches compression when installed.

Furthermore, the axial dimension of grooves 242 and 244 is approximately twice the diameter of the O-ring seal, thereby permitting O-ring seals 246 and 248 to move axially outwardly within seal grooves 242 and 244, respectively, in response to the pressure differential between discharge pressure space 74 and the opposite side of the protuberance exposed to the refrigerant at suction pressure being transported through suction conduit 208. Because each end of suction conduit 208 is subjected to opposing forces generated by the same pressure differential, there is no net axial force acting on the conduit.

When assembling suction line connector assembly 200 of the present invention, outer fitting member 218, including threaded nut 220, is first removed. Suction conduit 208, with O-ring seals 246 and 248 installed, is then inserted through fitting bore 204 until first end portion 210 is sealingly received within fitting bore 204 and second end portion 212 is sealingly received within cylindrical sealing surface 236 of suction inlet bore 206. Outer fitting member 218 is then installed so that suction conduit 208 is axially restrained. Specifically, a narrowing 250 of fitting member 218 provides an axial stop for conduit distal end surface 252. Likewise, step 254 in suction inlet bore 206 provides an axial stop for conduit proximal end surface 256. An axial space 258, which may be divided between either conduit end surface and its respective stop, permits limited radial movement of compressor mechanism 44 with respect to housing 12. Removal of suction conduit 208 through fitting bore 204 is facilitated by the provision of a step 260 formed by a counterbore made in second end portion 212. An expanding tool may be introduced through the conduit opening adjacent first end portion 210, and then engaged with step 260 for easy retraction of the conduit.

Referring once again to mounting assemblies 54 of the present invention, it is necessary that these mounting assemblies limit the displacement of compressor mechanism 44 relative to housing 12, to prevent damage to suction conduit 208 and O-ring seals 246 and 248. In the preferred embodiment of mounting assembly 54 shown in FIG. 3, a steel mounting block 262 is welded to the inside wall of housing top portion 14. Mounting block 262 includes an axially oriented threaded hole 264. Mounting flange 52 of crankcase 46 is suspended from mounting block 262 by means of an assembly comprising a threaded stud 266, a spacer 268, a pair of washers 270 and 272, a retaining nut 274, and a ring-shaped rubber grommet 276. In the preferred embodiment, grommet 276 is a neoprene bushing. Spacer 268 may be an integrally formed central portion of threaded stud 266, having increased diameter relative to the top and bottom threaded ends thereof. Alternatively, a separate sleeve-type spacer may be used.

More specifically, threaded stud 266 is received into threaded hole 264 so as to extend downwardly therefrom. As shown in FIG. 3, spacer 268 is flanked by washers 270 and 272, and the three are retained adjacent one another by retaining nut 274. Where spacer 268 is an integral part of stud 266, washer 270 is retained intermediate block 262 and spacer 268 by threading stud 266 into hole 264. Grommet 276 surrounds spacer 268 and, in turn, fills bore 278 provided in mounting flange 52 of crankcase 46. The diameter of washers 270 and 272 is greater than that of bore 278, whereby mounting assembly 54 limits axial movement of compressor mechanism 44, e.g., during shipping. Lateral displacement of the compressor mechanism during operation is resiliently restrained by the transmission of forces from mounting flange 52 to housing 12, through grommet 276.

It will be appreciated that transmission of noise from compressor mechanism 44 to housing 12 is minimized not only by grommet 276, but also by the small annular contacting area between mounting flange 52 and bottom washer 272. This contacting area is minimized by the sizing of washer 272 and bore 278 to insure continuous annular contact for the expected maximum lateral displacement of the compressor mechanism relative to the housing. In one embodiment, the diameter of washer 272 is approximately 0.090 inches greater than that of bore 278. It is also appreciated that grommet 276, when made of neoprene, may initially have a diameter approximately 0.20–0.030 inches less than bore 278. However, upon exposure of the grommet to the operating environment within housing 12, the grommet swells to fill bore 278.

It can be seen from FIG. 3 that top washer 270 is ordinarily spaced from the top surface of mounting flange 52 when the compressor mechanism is axially supported by bottom washer 272. However, the top surface of flange 52 will contact top washer 270 after upward movement of the compressor mechanism in response to a force as would be experienced during shipping. During compressor operation, axial movement does not ordinarily occur. The spacing between top washer 270 and the top surface of mounting flange 52 is determined by the axial length of spacer 268 and is designed to protect the components of suction line connector assembly 200.

FIG. 3 also shows a discharge fitting 280 provided in bottom portion 18 of housing 12 located directly beneath suction line connector assembly 200. The location of discharge fitting 280 in a central or lower portion of the housing provides an advantage in that the fitting acts as a dam and limits to about 20 lbs. the amount of refrigerant charge that will be retained by the compressor and required to be pumped out upon startup.

It should be noted that the resilient mounting system of the present invention, according to the disclosed embodiment, permits easy assembly of the compressor mechanism within housing 12, prior to the attachment of top portion 14 to bottom portion 18. Specifically, each mounting block 262 is welded to the inside wall of top portion 14, after which a respective threaded stud 266 is attached to the mounting block with top washer 270 retained therebetween. The compressor mechanism is then placed within the housing top portion such that threaded studs 266 coaxially extend through respective bores 278 with grommets 276 operatively placed therein. Bottom washer 272 is then retained against spacer 268 by retaining nut 274. The top and bottom housing portions are then sealingly attached.

It will be appreciated that the foregoing is presented by way of illustration only, and not by way of any limitation, and that various alternatives and modifications may be made to the illustrated embodiment without departing from the spirit and scope of the invention.

What is claimed is:

1. In a vertically disposed compressor assembly comprising a compressor mechanism within a hermetically sealed housing having a sidewall, wherein said compressor mechanism includes a radially extending mounting flange having a top surface and a bottom surface, a mounting apparatus for resiliently mounting said compressor mechanism to said housing sidewall, comprising:

a plurality of circumferentially spaced mounting bores formed in said mounting flange, each said mounting bore extending vertically through said mounting flange between said top surface and said bottom surface thereof;

a plurality of anchoring members corresponding to said plurality of mounting bores, each said anchoring member being connected to said housing sidewall and extending substantially coaxially through a respective said mounting bore, thereby defining an annular space intermediate the anchoring member and the mounting bore;

a plurality of resilient members corresponding to said plurality of mounting bores, each said resilient member being disposed within a respective mounting bore in a manner to substantially occupy said annular space; and a plurality of axial support means corresponding to said plurality of anchoring members, for axially supporting said compressor mechanism, each said axial support means being connected to a respective anchoring member and contacting said mounting flange bottom surface at a location thereon circumjacent a respective said mounting bore, whereby said compressor mechanism is axially supported and movement of said compressor mechanism in a lateral plane is resiliently restrained.

2. The mounting apparatus of claim 1 in which:

said mounting flange includes an outer peripheral edge, said edge being spaced radially inwardly from said housing sidewall to define an annular passage therebetween providing fluid communication around said mounting flange.

3. The mounting apparatus of claim 1 in which:

each of said plurality of anchoring means comprises a vertically disposed elongate stud member, each said stud member being connected at an end thereof to said housing sidewall in fixed spaced relation thereto.

4. The mounting apparatus of claim 3 in which:

each of said plurality of anchoring means comprises axial support means for supporting said compressor mechanism, and axial limiting means for limiting upward movement of said compressor mechanism, said axial support means comprising a radially extending bottom retaining member connected to a bottom end of said respective stud member, said axial limiting means comprising a radially extending top retaining member connected to a top end of said respective stud member, said top and bottom retaining members having respective diameters greater than the diameter of said respective mounting bore.

5. The mounting apparatus of claim 3 in which:

each said stud member is connected at a top end thereof to said housing sidewall and extends downwardly through a respective said mounting bore.

6. The mounting apparatus of claim 5 in which:

each of said plurality of axial support means comprises a radially extending bottom retaining member connected to a bottom end of said stud member, the diameter of said bottom retaining member being greater than the diameter of said respective mounting bore, whereby an outer peripheral portion of said bottom retaining member contacts an annular area of said mounting flange bottom surface circumjacent a respective said mounting bore.

7. The mounting apparatus of claim 1 and further comprising:

said plurality of anchoring members, for limiting upward movement of said compressor mechanism, each said axial limiting means being connected to a respective anchoring member and being spaced from said mounting flange top surface when said mounting flange bottom surface is contactingly resting on a corresponding said axial support means, said axial limiting means contacting said flange member top surface after limited upward movement of said compressor mechanism.

8. The mounting apparatus of claim 7 in which:

each of said plurality of axial limiting means comprises a radially extending top retaining member connected adjacent a respective stud member top end, the diameter of said top retaining member being greater than the diameter of said respective mounting bore, whereby an outer peripheral portion of said top retaining member is capable of contacting an annular area of said mounting flange top surface circumjacent a respective said mounting bore.

9. The mounting apparatus of claim 1 in which:

said housing comprises a top portion and a bottom portion, said top and bottom portions being hermetically connected to one another, said plurality of anchoring means being connected to said top portion.

10. The mounting apparatus of claim 1 in which:

said compressor assembly is a direct suction hermetic compressor having a suction inlet means extending between said housing sidewall and said compressor mechanism for introducing refrigerant from outside said housing to said compressor mechanism therein.

11. A compressor assembly, comprising:

a vertically disposed hermetically sealed housing including a sidewall;

compressing means within said housing for compressing refrigerant, including a compressor mechanism having a crankcase, said crankcase including a radially extending mounting flange having a top surface, a bottom surface, and a plurality of circumferentially spaced vertical bores extending therebetween; and means for mounting said compressing means to said housing sidewall, said means including:

a plurality of vertically disposed elongate stud members corresponding to said plurality of vertical bores, each said stud member being connected at one end thereof to said housing sidewall in fixed spaced relation thereto;

a plurality of resilient bushings corresponding to said plurality of vertical bores, each said bushing being received within a respective said vertical bore and including a central aperture through which a respective said stud member extends, whereby said bushing is intermediate said stud member and said vertical bore for resiliently limiting lateral movement therebetween; and means connected to each said stud member and contacting said mounting flange bottom surface, for axially supporting said compressing means.

12. The compressor assembly of claim 11 in which:

said compressor assembly is a direct suction hermetic compressor having a pressurized housing interior and a suction inlet means extending between said housing sidewall and said crankcase for introducing refrigerant from outside said housing to said compressing means therein; and said mounting flange includes an outer peripheral edge, said edge being spaced radially inwardly from said housing sidewall to define an annular passage therebetween providing fluid communication around said mounting flange.

13. The compressor assembly of claim 11 in which:

said means for axially supporting said compressing means comprises a radially extending retaining member connected to a bottom end of said stud member, the diameter of said retaining member being greater than the diameter of said respective vertical bore, whereby an outer peripheral portion of said retaining member contacts an annular area of said mounting flange bottom surface circumjacent a respective said vertical bore.

14. The compressor assembly of claim 11 and further comprising:

means connected to each said stud member and ordinarily spaced from said mounting flange top surface, for limiting upward movement of said crankcase, said means contacting said mounting flange top surface after upward movement of said crankcase.

15. The compressor assembly of claim 11 in which:

said housing comprises a top portion and a bottom portion, said top and bottom portions being hermetically connected to one another, each said stud member being connected at a top end thereof to said housing top portion and extending downwardly through a respective said vertical bore.

16. A compressor assembly, comprising:

a vertically disposed hermetically sealed housing including a sidewall;

compressing means within said housing for compressing refrigerant, including a compressor mechanism having a crankcase, said crankcase including a radially extending mounting flange having a top surface, a bottom surface, and a plurality of circumferentially spaced vertical bores extending therebetween; and means for mounting said compressing means to said housing sidewall, said means including:

a plurality of circumferentially spaced mounting blocks corresponding to said plurality of vertical bores, each said mounting block being attached to said housing sidewall;

a plurality of vertically disposed elongate stud members corresponding to said plurality of mounting blocks, each said stud member being connected at a top end thereof to a respective said mounting block and extending downwardly within said housing in spaced relation to said housing sidewall, each said stud member having an unattached bottom end;

a plurality of resilient bushings corresponding to said plurality of vertical bores, each said bushing being received within a respective said vertical bore and including a central aperture through which a respective said stud member extends, whereby said bushing is intermediate said stud member an said vertical bore for resiliently limiting lateral movement therebetween; and means connected to each said stud member bottom end and contacting an annular area of said mounting flange bottom surface circumjacent a respective said mounting bore, for axially supporting said compressing means.

17. The compressor assembly of claim 16 in which:

each of said plurality of stud members is threadedly attached to a respective said mounting block.

18. The compressor assembly of claim 16 in which:

said means for axially supporting said compressing means is threadedly attached to each said stud member bottom end.

19. The compressor assembly of claim 16 in which:

each of said plurality of stud members includes a central portion having increased diameter relative to said top and bottom ends adjacent thereto, said central portion being received within a respective said bushing central aperture; and said means for axially supporting said compressing means comprises an annular bottom washer received onto a respective said stud member bottom end and retained against said central portion, said bottom washer having a greater diameter than said vertical bore, whereby an outer peripheral portion of said bottom washer contacts an annular area of said mounting flange bottom surface circumjacent said vertical bore.

20. The compressor assembly of claim 19 and further comprising:

means connected to each said stud member and capable of contacting said mounting flange top surface after upward movement of said crankcase, for limiting upward movement of said crankcase, said means comprising an annular top washer received onto a respective said stud member top end and retained intermediate a respective said mounting block and said stud member central portion, said top washer having a greater diameter than said vertical bore, whereby an outer peripheral portion of said top washer contacts an annular area of said mounting flange top surface circumjacent said vertical bore after upward movement of said crankcase.

* * * * *

UNITED STATES PATENT AND TRADEMARK OFFICE

CERTIFICATE OF CORRECTION

PATENT NO. : 5,007,807

DATED : April 16, 1991

INVENTOR(S) : Edwin L. Gannaway

It is certified that error appears in the above-identified patent and that said Letters Patent is hereby corrected as shown below:

Column 9, line 19, delete "0.10-0.15" and substitute therefor -- 0.010-0.015 --.

Column 10, line 35, delete "0.20" to --0.020--.

Claim 7, column 12, line 23, before "said" insert --a plurality of axial limiting means corresponding to--.

Claim 16, column 14, line 19, delete "an" and substitute therefor --and--.

Signed and Sealed this

Twenty-fifth Day of August, 1992

*Attest:*

DOUGLAS B. COMER

*Attesting Officer*

*Acting Commissioner of Patents and Trademarks*